US007980299B1

(12) United States Patent
Manulik

(10) Patent No.: US 7,980,299 B1
(45) Date of Patent: Jul. 19, 2011

(54) HORIZONTAL WELL TREATING METHOD

(76) Inventor: Matthew C. Manulik, Midland, TX (US)

( * ) Notice: Subject to any disclaimer, the term of this patent is extended or adjusted under 35 U.S.C. 154(b) by 275 days.

(21) Appl. No.: 12/001,955

(22) Filed: Dec. 12, 2007

(51) Int. Cl.
*E21B 23/12* (2006.01)
*E21B 43/16* (2006.01)

(52) U.S. Cl. ..... 166/117.6; 166/50; 166/69; 166/117.7; 166/223; 166/305.1

(58) Field of Classification Search ..... 166/50, 166/69, 117.5, 117.6, 222, 223, 117.7
See application file for complete search history.

(56) References Cited

U.S. PATENT DOCUMENTS 3,268,004 A * 8/1966 Kiel ..... 166/106
3,430,701 A 3/1969 Canada
4,387,770 A 6/1983 Alfred
4,410,216 A 10/1983 Allen
4,625,803 A 12/1986 Walhaug et al.
4,842,068 A 6/1989 Vercaemer et al.
4,951,751 A 8/1990 Jennings, Jr.
5,211,240 A 5/1993 Gadelle et al.
5,318,121 A * 6/1994 Brockman et al. ..... 166/313
5,330,004 A 7/1994 Williams et al.
5,353,874 A 10/1994 Manulik
5,464,059 A 11/1995 Kristiansen
5,507,342 A 4/1996 Copeland et al.
5,718,289 A 2/1998 Schnatzmeyer et al.
5,782,302 A 7/1998 Ringgenberg et al.
5,803,177 A 9/1998 Hriscu et al.
5,884,701 A 3/1999 Von Plahn
5,947,200 A 9/1999 Montgomery
6,260,622 B1 7/2001 Blok et al.
6,367,548 B1 4/2002 Purvis et al.
6,481,503 B2 11/2002 Hamilton et al.
6,575,247 B2 6/2003 Tolman et al.
6,655,461 B2 * 12/2003 Eslinger et al. ..... 166/305.1
2001/0050172 A1 * 12/2001 Tolman et al. ..... 166/297

* cited by examiner

*Primary Examiner* — Zakiya W Bates
*Assistant Examiner* — Angela M DiTrani
(74) *Attorney, Agent, or Firm* — Peter V. Schroeder; Booth Albanesi Schroeder LLC

(57) ABSTRACT

Method of treating, especially, horizontally deviated wellbores where various treating solutions such as, acids, slurries, proppants, fracturing fluids, flushing fluids, or sealants are transferred into an annulus formed by a casing in the well and a working string. The working string has a seal member providing a sliding seal with the casing, a perforated nipple above the seal, and a check valve above the perforated nipple for preventing back flow through the working string to the surface. The working string has a seal element at the wellhead to avoid treating solutions leaking from the annulus out the wellhead. Treating solution of the desired make-up is pumped into the annulus, through the perforated nipple, down the working string, along the horizontal deviated wellbore, then into the strata or formation through a dispersing tool for the particular treating solution. The method provides a decrease in head loss, and if the working string uses a solid rod of lesser diameter than the remainder of the working string the head loss is further minimized. The apertures in the perforated nipple may be selected according to the requirements of the treating solution being pumped into the formation.

20 Claims, 3 Drawing Sheets

HORIZONTAL WELL TREATING METHOD

FIELD OF INVENTION

This invention relates generally to methods of treating subterranean hydrocarbon bearing formations for enhanced production, and more particularly for treating and/or stimulating vertical and horizontal wellbores penetrating subterranean formations for recovery of oil and gas or other liquid or gaseous substances, and more specifically to methods for stimulating and treating horizontal strata through boreholes deviating from vertical and extending into the horizontal strata.

BACKGROUND ART

Various techniques are known for treating oil and gas formations or strata with fluorides, acids, fracturing, flushing fluid, proppants, stimulating chemicals, and other treatments to enhance recovery of hydrocarbons or other formation fluids. Such methods would include pumping directly down the casing with perforations in the casing adjacent to desired strata of the subterranean structure. Tools for injecting treating fluids of various types which may include dispersed solids or gel generally include a pair of axially spaced packers between which the treating fluids are injected through perforation in a casing or directly into exposed hydrocarbon bearing strata. Some tools use several axially spaced swabs defining several annular spaces between the tool body and perforated areas of the casing with perhaps two concentric tubes supplying the same or different treatment solutions in each of the annular spaces for injection into the formation. U.S. Pat. No. 6,260,622 B1 describes such a tool.

Other techniques include a tool having an inlet from the casing and a tube extending downward within the production string for injecting flushing fluid into the production string just below the perforations in the casing during production. This particular arrangement requires an injection valve insert assembly as described in U.S. Pat. No. 5,718,289 granted Schnalzmeyer.

With advances in drilling technology, it is currently possible to drill horizontal wellbores deep into hydrocarbon strata or reservoirs. Utilization of horizontal wellbores allows extended contact with a reservoir or producing formation, thereby facilitating drainage and production from the reservoir. It is often necessary to hydraulically fracture or stimulate the reservoir through which the horizontal wellbore has penetrated.

Although horizontal wellbores allow more contact with the producing formation, some difficulties are encountered when horizontal wellbores are utilized which are not commonly experienced when vertical wells are used. Methods utilized in producing hydrocarbons from a formation or reservoir via vertical wells often proves to be inefficient when attempting to remove hydrocarbons from a reservoir where horizontal wellbores are drilled.

Jennings, Jr., in U.S. Pat. No. 4,951,751, describes a method of staging a fracturing treatment in horizontal wellbores where solidified gel is utilized as a diverting medium. As described, a horizontal wellbore is perforated at the end furthest from the angle of deviation from vertical of the wellbore so as to allow fluid communication with a desired interval of a formation. Once the desired perforations have been placed into the furthest end of the wellbore, a hydraulic fracturing operation is conducted through said perforations so as to fracture the desired interval of the formation. Thereafter, a solidifiable gel containing a gel breaker is injected into the wellbore where the perforations are made. Afterwards, a wiper plug is injected into the formation thereby displacing the gel to an area adjacent to the fractured interval. The solidifiable gel is allowed to form a solid gel in the formation adjacent to the perforations and a solid gel plug in the wellbore.

After the desired number of perforations have been placed into the wellbore so as to allow fluid communication with another interval of the formation closer to the angle of deviation from vertical and adjacent to said first interval, hydraulic fracturing is initiated so as to fracture a second desired interval of a formation. This activity is repeated as appropriate for the formation, then the gel breakers cause the solid gel in the formation and the gel plug to liquefy, after which injection pressure is applied so the wiper plugs are pumped out the perforations of the wellbore.

One of the problems in treating horizontal wellbores is getting a substantial volume of treating solutions in the appropriate region of the formation under pressure. Thus, it is necessary to pump the solutions at a high rate of volume (gal/min). Coiled tubing is used in some cases, U.S. Pat. Nos. 5,507,342, and 5,884,701 for example, for delivering treating solutions into formations. However, coil tubing come in specific length and when positioned in a formation for treatment, the treating fluid must be pumped through the entire length of the coiled tubing resulting in considerable friction and decrease in flow rate, although, while pumping, the coiled tubing may be reciprocated in the formation especially, horizontal boreholes in hydrocarbon bearing strata.

For treating extensive strata exposed to horizontal borehole conventional jointed tubing requires treating the furthest end of the deviated horizontal borehole from the vertical borehole. In order to accomplish such borehole treatment by connecting the treating solution pumping unit to a working string at the wellhead after the joints are run in the borehole to the end of the horizontal borehole with the treating solution dispersing tool at the end of the working string. Next the treating solution is pumped down the working string at the appropriate pressure and rate while the working string is being withdrawn from the borehole. After the first joint of tubing is pulled, the pumping of treating solution is stopped, the connection to the working string is uncoupled, and the pipe joint uncoupled from the working string. Then, the pumping unit must be reconnected and resume pumping treating solution down the working string and into the formation while the next pipe joint is being pulled and then stopping the treating operation to uncouple the pipe joint from the working string. The foregoing procedure is repeated until treatment of the borehole is complete. The foregoing procedure is time consuming and inefficient.

It should be apparent that a simpler and more efficient arrangement is needed to effectively treat strata or formations penetrated by horizontally deviated boreholes from the vertical.

SUMMARY OF THE INVENTION

The present invention provides a method of treating underground strata for increasing porosity and permeability by injecting various chemicals, treating solutions etc. into the strata by positioning a packer or other known device in the annulus between a casing an working string of a well to provide a sliding seal between the packer and the casing. A perforated nipple is positioned in the working string at a location above the packer. A check valve is placed above the perforated nipple in the working string to prevent flow of fluid upward in the working string. The wellhead has a seal permitting relative movement of the working string, but prevents fluid being put into the annulus between the casing and the working string leaking through the wellhead. The treating fluid or solution is pumped into the annulus through the perforated nipple and into the working string which may have any of the various dispersing members available attached to the working string or may be merely an open end in the working string.

In a further arrangement the working string has at least one dispersing fitting in the working string communicating with the borehole penetrating horizontal strata.

In another embodiment the check valve in the working string is such that where appropriate in a sector of the formation treating fluid can be supplied through the working string and the annulus between the casing and the working string. Likewise, compatible treating fluids may be supplied from separate sources mixed in the working string or intermittently injected from one or the other.

A method of treating a deviated wellbore extension from a vertical cased wellbore utilizing a working string extending from the surface throughout the vertical and deviated area in the wellbore which includes a perforated nipple in the working string communicating with the annulus between the casing and the working string, providing a packer below the perforated nipple forming a slidable seal with the casing, and a wellhead seal allowing relative movement of the working string. Further, inserting a check valve in the working string above the perforated nipple to prevent substantial flow of fluid through the check valve to the surface. The various treating fluids are then pumped down the casing through the perforated nipple into the working string and the deviated wellbore. In an alternative embodiment the check valve and all the tubing above the check valve can be replaced with solid rods attached to the perforated nipple, thus increasing the annulus area above the perforated nipple, and further decreasing head loss in transferring treating solution into the formation or strata.

It is an object of the present invention to provide a simple, direct method of treating wellbores in horizontal strata with various fluid treating solutions including acidizing, fracturing etc. by transferring such treating solution down the casing of the wellbore through a perforated nipple into a working string and then into the formations. A packer is used in sliding contact with the casing to divert treating solutions from the casing through the perforated nipple and a check valve in the working string to prevent backflow up the working string. The working string is slidingly sealed to the wellhead at the surface to prevent backflow from the casing through the wellhead. The working string may be manipulated (rotated or reciprocated) within the horizontal strata while continuously pumping treatment solution into the formation through the annulus.

In another aspect of the present invention, the working string has a sliding seal with the wellhead and a packer position preferably near the bottom of a vertical casing forming a sliding seal with the casing in the borehole. The working string includes a perforated nipple inserted just above the packer and includes a check valve in the working string above the perforated nipple to block backflow from the casing through the working string, the weight of treating fluids in the working string is thereby minimized and the working string can be raised and lowered while dispersing treatment solutions, fracturing, acidifying or otherwise as appropriate into the horizontal formation encountered. The use of the maximum annulus length to transfer treating solutions into the horizontal borehole decreases the head loss considerable.

Another method of treating a strata or formation penetrated by a deviated borehole branch of the vertical borehole utilizing the annulus between a vertical casing in the borehole and a working string having a sliding seal to the casing, a perforated nipple above the seal and a check valve above the perforated nipple to prevent back flow through the working string to the surface where the sliding seal maximizes the annulus capacity when pumping treating solution into the annulus for transference from the annulus through the perforated nipple into the working string and then through a dispersing tool into the surrounding strata or formation while the working string is slowly withdrawn through the strata or formation.

Additionally, the present invention provides a method of treating for enhanced production extensive horizontal boreholes by transferring a high volume of treating solutions under pressure through the annulus between a casing and a working string to the working string through a perforated nipple in the working string above a packer making a sliding seal with the casing, attaching a solid rod to the perforated nipple blocking upward flow of the solution, transferring treating solution from the working string out a dispersing tool, and manipulating the working string in the horizontal borehole to effectively continuously or intermittently disperse the treating solutions as appropriate into the strata or formation.

DESCRIPTION OF PREFERRED EMBODIMENT

Figure 1:
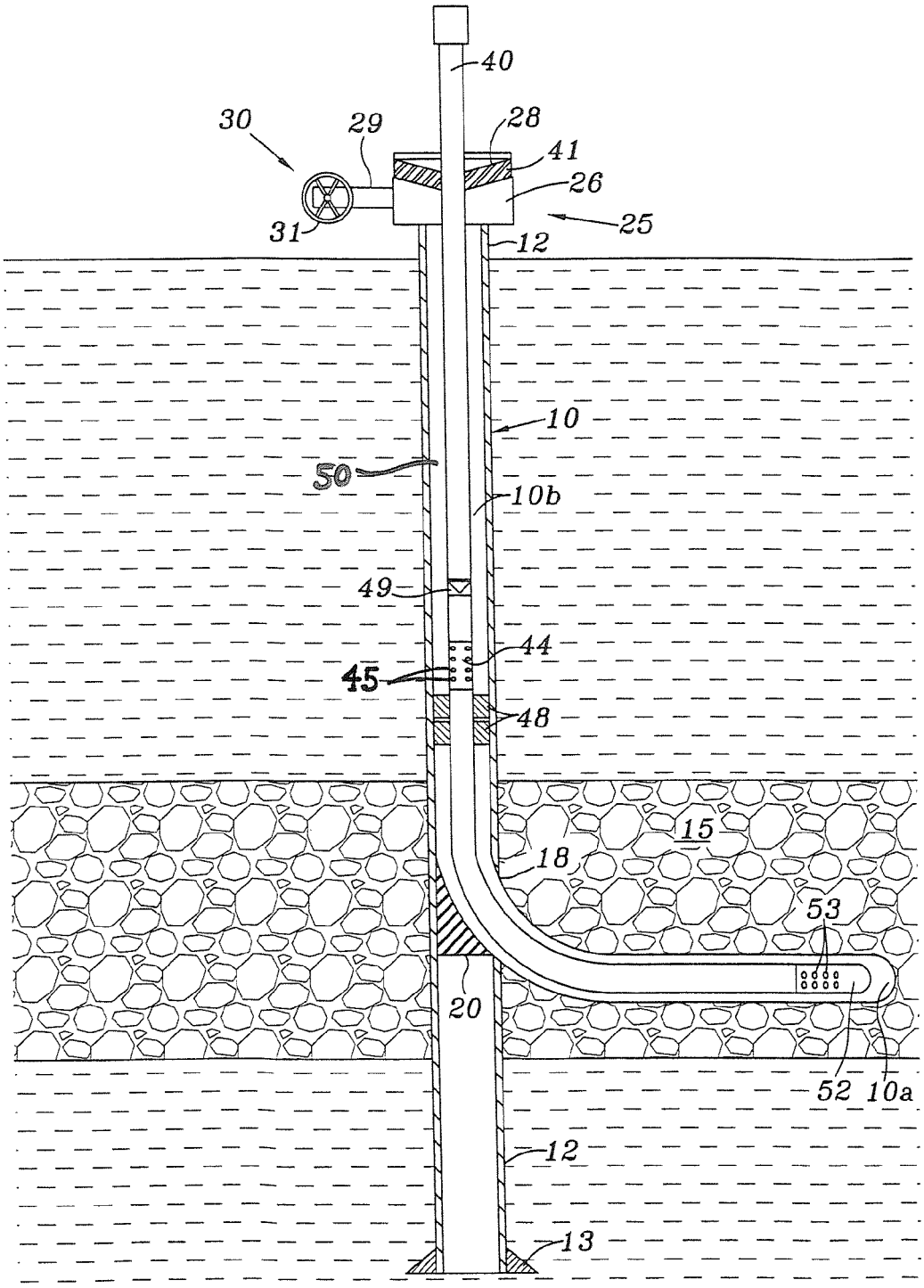
FIG. 1 illustrates a wellbore with a deviated segment from the vertical extending generally in the horizontal strata of a hydrocarbon producing zone for dispersing treating solutions through the casing, into the working string and then into the desired areas of the formation.

Referring to the drawings, FIGS. 1, 2, 2A and 3, the preferred embodiment of the present invention is described hereafter. Borehole 10 penetrates vertically and extends horizontally in formation or strata 15. Vertical casing 12 extends below strata 15 and affixed by footing 13. Casing 12 has a sidewall cutout 18 with whipstock 20 seated in casing 12 just below and adjacent to cutout 18 which facilitates deviated drilling of uncased portion 10*a* of borehole 10, as well as, working string 40 which on occasion may be referred to as tubing or pipe string. In one embodiment, deviated boreholes may extend from uncased portion 10*a* of borehole 10 or below casing 12 in the vertical section of a cased borehole 10*b*. Likewise, the deviated boreholes or laterals 11*a* and 11*b* (see FIG. 3) may have casings, liners or the like where desired.

Wellhead 25 includes housing 26 with cap or cover 28. Inlet conduit 29 has conventional control valve 30, which may be opened or closed by handle 31, and provides for the inflow of various treating solutions of known contents for treating formations to increase production of hydrocarbons therefrom. In order to pump treating solutions into annulus 50 between casing 12 and working string 40, wellhead 25 is provide with suitable seal 41 to working sting 40 which permits raising, lowering and/or rotating thereof; seal 41 may be rubber or other suitable material. Beaumont Iron Works initiated such a rubber seal which is generally referred to as the BIW seal in the "oil patch."

Working string 40 includes perforated nipple 44 with multiple apertures 45 of any suitable size to accommodate the particular treating solution. Below perforated nipple 44, packer or other suitable sealing member 48 is position in the working string 40 to form a sliding seal with casing 12. Check valve 49 is positioned in working string 40 above perforated nipple 44 to prevent back flow up working string 40 to the surface. As illustrated working string 40 has dispersing tool 52 with apertures 53 attached to working string 40 for dispersing treating solutions, proppants, fracturing fluid, etc. into the formation or strata. Dispersing tool 52, as shown, is at the extremity of open or uncased portion 10*a* of borehole 10 and sealing member 48 engages casing 12 proximal deviated or uncased portion 10*a* of borehole 10. In this embodiment, the maximum volume of annulus 50 is utilized to disperse treating solution into strata 15 with the least amount of head loss or pressure drop from friction.

Figure 2:
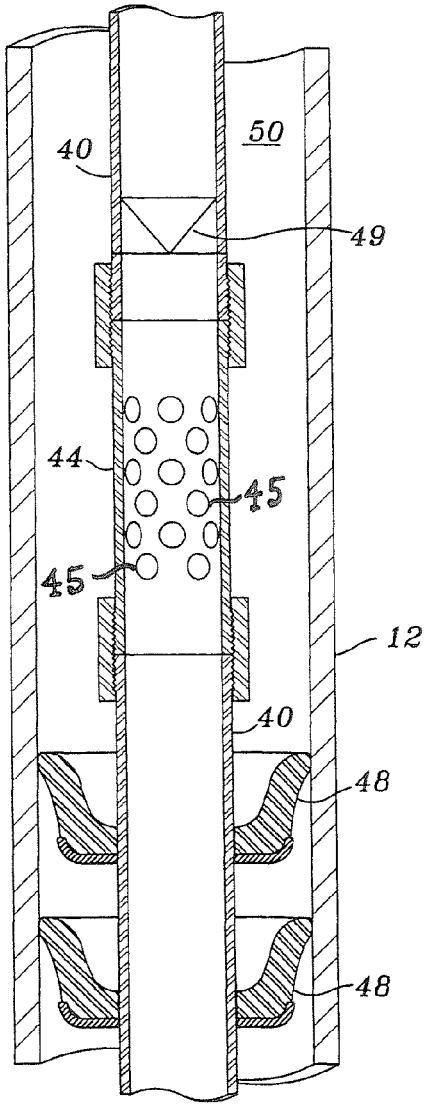
FIG. 2 illustrates an enlarged section depicting the arrangement for transferring treatment solutions from the casing to the working string and preventing back flow up the working string to the surface.
Figure 2A:
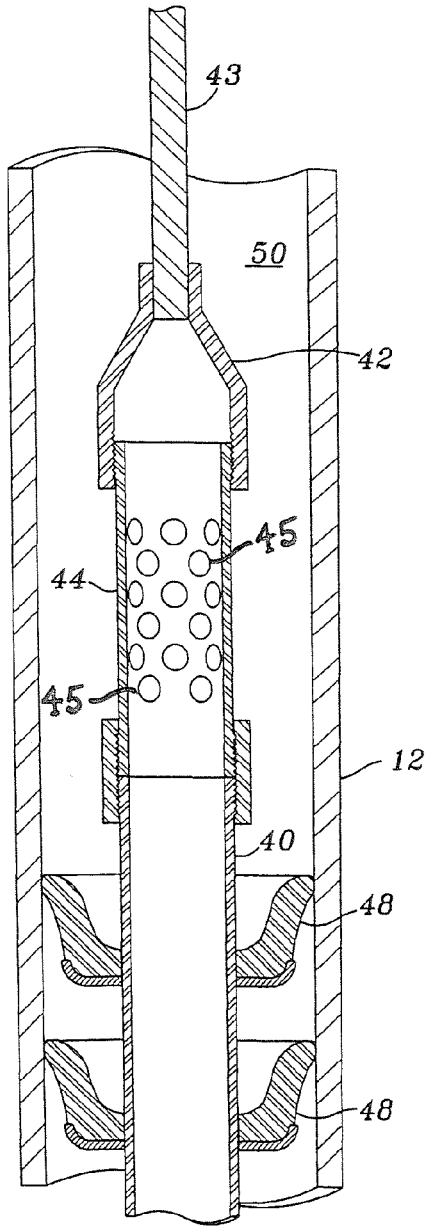
FIG. 2A illustrates a modification to the working string of FIG. 2 where the working string is a solid rod above the perforated nipple.

Referring to FIG. 2A, in an alternate embodiment, annulus 50 may be significantly increased in volume. In this alternate embodiment, pipe string 40 above perforated nipple 44 has reducer 42 directly attached to the top of perforated nipple 44 and the first joint of solid rod 43 is connected to reducer 42 with the entire section of working string 40 above perforated nipple 44 replaced by joints of solid rod 43. Hence, several thousand or more feet of working string 40 being replaced with lesser diameter solid rods 43 than the working string, the annulus 50 has a greatly increase volume which further reduces the head loss in pumping treating solutions into strata or formation.

Figure 3:
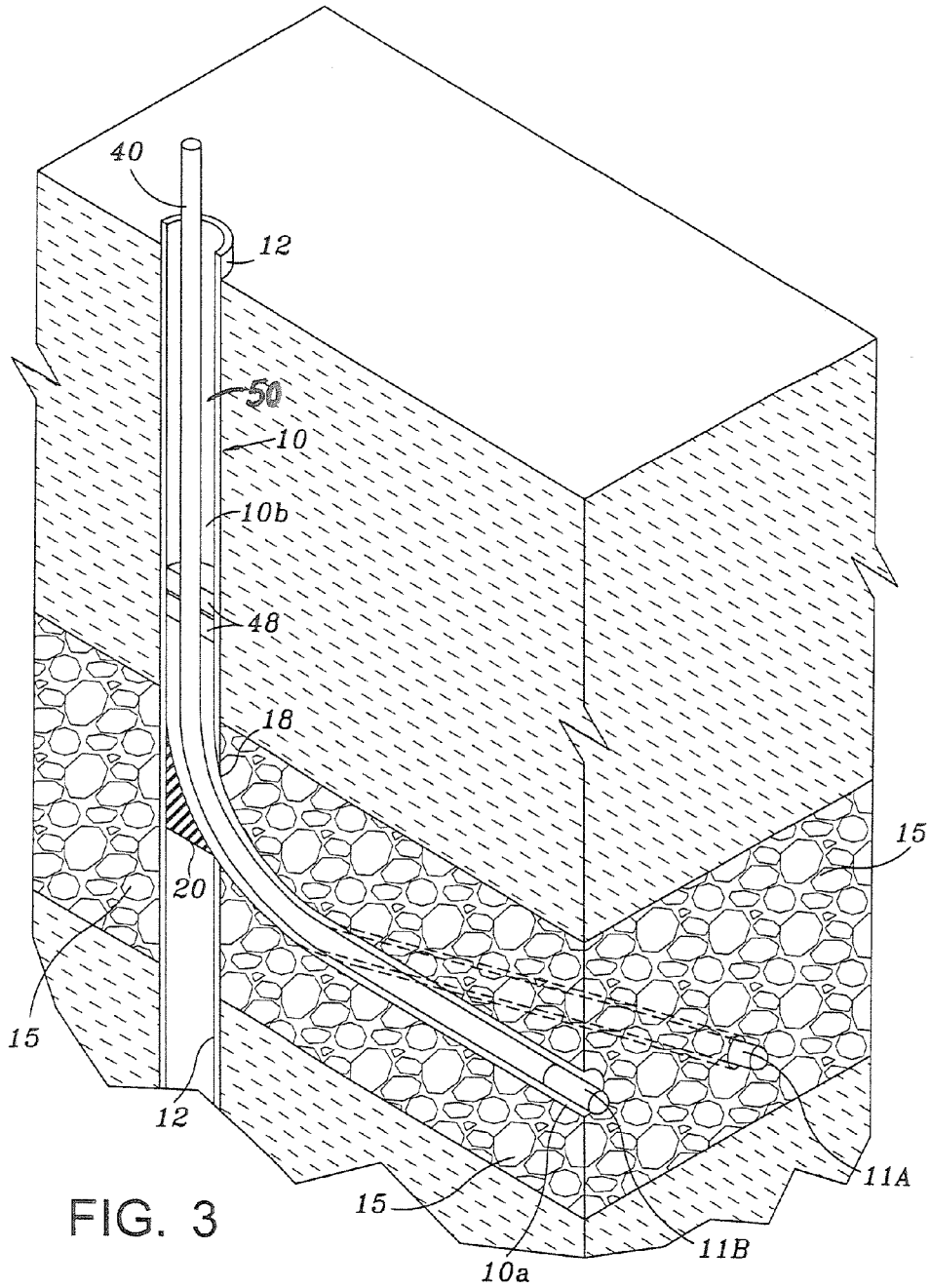
FIG. 3. illustrates a vertical wellbore with two radially deviated boreholes angularly displaced from each other.

In another embodiment, see FIG. 3, open borehole 10*a* may have several deviated laterals 11*a* and 11*b* from the vertical area of borehole 10 penetrating formation 15 which can be treated by withdrawing working string 40 with dispersing tool 52 out of lateral 11*a*, rotate the working string 40 to the opening of a second lateral, and extend working string 40 with dispersing tool 52 into the extremity of the second lateral and treat formation 15 by withdrawing working string 40 out of lateral 11*b* while dispersing treating solutions into strata or formation 15.

Well Treating Examples

The following are well treating examples of the present invention and should not be taken as a limitation of the scope of the invention.

Example I

A well in the San Andres formation would typically be treated in the following way. Initially, if a producing string or other tubing was in the well, then a pulling unit would be connected and the string removed from the well. The well is cased with 4½ inch pipe to 6000 feet with a whipstock in place to facilitate the lateral deviation topped at a depth of 5200 feet below the surface. The whipstock remains in place where the lateral deviation from the casing occurred. This deviated lateral is 3000 feet beyond the casing, thus the borehole length from the surface to the end of the lateral is 8200 feet.

For this well, 3200 feet of 2⅜ inch tubing with a perforated nipple bull plugged affix on the end of the first joint would be run in the cased borehole. Next, a casing seal assembly (such as a packer) would be attached, a perforated nipple would be installed above the seal assembly then a check valve would be inserted above the perforated nipple. In sequence, 5000 feet of pipe would be attach to the string of 2⅜ inch tubing and would be run in the borehole. Thus, the perforated nipple bull plugged would be positioned near the end of the deviated lateral.

With the working string now fully within the borehole, the BIW stripper rubber would be affixed in the wellhead and the acid pump or pumps would be coupled to the annulus between the 4½ inch casing and the 2⅜ inch tubing or working string.

In the next step, the deviated lateral would be treated with 75,000 gallons of acid (appox. 1785 bbls) at 10 bbls per minute while pulling the working string out of the hole at 17 ft/minute.

Example II

A typical well in the San Andres formation capable of having two or more lateral extending from a vertical borehole would be treated in the following manner. The vertical borehole would be cased with 4½" casing an appropriate distance below the 6,000 foot depth. A deviated horizontal borehole would extend from a cut out in the casing at 6,000 feet to 6,200 feet and then would branch into lateral No. 1 and No. 2 each 3,000 feet in the formation.

1. For this well, 3400 feet of 2⅜" pipe with a perforated nipple-bull plugged, then a bent joint and UBHO (universal Bottom Hole Orienting Sub) with the orientation prong set with bend of bent joint (the "bottom hole assembly") on the end of the first joint would be run in the borehole. Next, 2400 feet of pipe would be run in hole, then, the wet connect hanging sub would be attached. A steering tool attached on a wireline would be run in the hole and seated in the UBHO over the orientation prong. The wireline would be clamped and cut, then attached to wet connect, and wet connect hung from the hanging sub.

2. Pipe would be attached and run in hole to a distance of 6,250 feet (50 feet beyond the track of either lateral No. 1 or No. 2).

3. Then wireline with connector would be run in hole and sting (couple) into the wet connect, and lateral telemetry would be measured to identify as lateral no. 1 or no. 2.

4. Then, wireline would be pulled out, and fishing tool run in hole to recover the steering tool, and then a check valve would be placed in pipe string.

5. Then, pipe would be run in hole 9,200 feet (extremity of lateral no. 1, the one identified) and then lateral no. 1 would be drag acid treated by, pumping acid into the annulus between the casing and pipe string, through perforated nipple into pipe string and into formation through a second perforated nipple (or other dispersing tool, if installed). The acid treatment would be at a rate of 10 bbls per minute while pulling the pipe string at 17 ft/min. Thus, approximately 1,765 bbls of acid would be dispersed in the formation.

6. After acid treating lateral no. 1, pipe string (or working string) would be pull until end of the bottom hole assembly is at 5,800 feet (within cased borehole), and the check valve would be removed. Then, steering tool would be run in hole on wireline and seated in UBHO over the prong. The wet connect would be hung, then pipe string would be run in borehole to 6,200 feet just before reaching side track juncture or branch. Then, wireline with connector would be run in hole and sting (couple) into the wet connect.

7. Next the bottom hole assembly would be rotated and steered into lateral No. 2 (the unstimulated lateral) and the position confirmed. Then, wireline would be pulled out of hole, and finishing tool run in hole to recover steering tool, then check valve set in pipe string. Next pipe string, with bottom hole assembly would be run in lateral No. 2 to its end. Lateral no. 2 would be drag acid treated similar to lateral no. 1.

Alternatively, to decrease head loss further, instead of inserting the check valve and attaching pipe to run in string, a solid rods of much lesser diameter could be used to replace the check valve and the pipe above the working string.

It should be recognized that treating solutions are pumped down annulus 50 through perforated nipple 44 and blocked from backflow by check valve 49 or alternatively by reducer 42 and solid rod 43, therefore working string 40 may be withdrawn and one or more joints may be removed from working string 40 to withdraw dispersing tool throughout uncase portion 10*a* of borehole 10. More joints may be returned to working string 40 for further treatment of portion 10*a* of borehole 10 or a second uncased lateral off of cased section 10*b* of borehole 10. In the process, the treating parameters may be maintained in the open portion 10*a* of borehole 10. Further, whenever necessary because the portion of the formation indicates under treating or unnecessary treating, working string 40 may be manipulated (extended, retracted or rotated) in open portion of borehole 10 to achieve the desired criteria for treating formation 15 in the particular area or section.

From the foregoing it is apparent that the present invention overcomes the use of excessive tubing as in coiled tubing strings to treat a formation, as well as, conventional tubing as in coiled tubing strings to treat a formation, as well as, conventional tubing where treating solution must be disconnected from the tubing to remove a joint and then reconnected to continue treatment.

What is claimed is:

1. A method of treating a subterranean formation having a wellhead, a vertical borehole, casing secured in the vertical borehole, and a deviated borehole extending radially from the vertical borehole and through the subterranean formation, the method comprising the steps of:

(a) attaching a treating solution dispersing tool onto a working string, the working string made up of a plurality of pipe joints, for extension into the extremity of the deviated borehole extending radially from the vertical borehole and through the subterranean formation;

(b) attaching to the working string a seal member for sealing the working string in sliding engagement with the casing;

(c) attaching a perforated nipple in the working string above the seal member;

(d) positioning a check valve member in the working string above the perforated nipple for preventing upward flow in the working string;

(e) positioning a sealing element at the wellhead between the working string and the casing allowing relative movement of the working string within the casing;

(f) pumping treating solution into an annulus between the casing and the working string, through the perforated nipple, into the working string, and out through the dispersing tool, into the deviated borehole and the formation;

(g) maneuvering the working string within the deviated borehole while pumping the treating solution into the deviated borehole through the dispersing tool; and (h) uncoupling one or more pipe joints of the working string while pumping the treating solution into the deviated borehole through the dispersing tool.

2. The method of claim 1 wherein the seal member attached to the working string remains within the casing while the dispersing tool is at an extremity of the deviated borehole.

3. The method of claim 1 wherein the treating solutions are selected from the group consisting of acids, slurries, proppants, fracturing fluids, flushing fluids or sealants.

4. The method of claim 1 wherein the seal member is attached to the working string in a location such that the working string with the dispersing tool extends to an extremity of the deviated borehole and the seal member remains engaged with the vertical casing.

5. The method of claim 1 wherein the treating solution is pumped continuously into the deviated borehole.

6. A method of using treating solutions to treat a subterranean formation penetrated by a borehole having a wellhead, a relatively vertical section and a deviated relatively horizontal section extending within the formation, the method comprising the steps of:

(a) positioning a casing in the vertical section at least above the deviation of the horizontal section;

(b) running a tubing string, made up of a plurality of pipe joints, in the borehole having:

(i) a treatment dispersing member in the tubing string for extension to the extremity of the deviated section of the borehole;

(ii) a sealing element attached to the tubing string for sliding engagement with the casing;

(iii) a perforated member inserted above the sealing element for communication with an annulus formed between the tubing string and the casing; and (iv) a check valve above the perforated member for blocking upward flow there through; and (c) positioning a sealing member at the wellhead to seal the tubing string with the casing, but allowing relative movement between the tubing string and wellhead;

(d) pumping treating solutions into the annulus for transference through the dispersing member into the subterranean formation; and (e) uncoupling one or more pipe joints of the tubing string while pumping the treating solution into the deviated borehole through the dispersing tool.

7. The method of claim 6 wherein the seal member attached to the tubing string remains within the casing while the dispersing tool at an extremity of the deviated borehole.

8. The method of claim 6 wherein the treating solutions are selected from the group consisting of acids, slurries, proppants, fracturing fluids, flushing fluids or sealants.

9. The method of claim 6 wherein the seal member is attached to the tubing string in a location such that the dispersing tool extends to an extremity of the deviated borehole and the seal member remains engaged with the vertical casing.

10. The method of claim 6 wherein the relatively vertical section has at least two deviated boreholes angularly spaced, and the treating solution is pumped into both deviated boreholes by maneuvering the tubing string sequentially into and out of one and then the other borehole.

11. The method of claim 10 wherein the treating solution is pumped intermittently into the casing or pumped selectively into the casing to treat selected portions of the subterranean formation.

12. The method of claim 6 wherein the treating solution is pumped continuously into the subterranean formation.

13. The method of claim 6 wherein the seal member maximizes the capacity of the annulus and minimizes head loss on transference of treating solution into the tubing string while dispersing treating solution throughout the subterranean formation.

14. A method of treating a subterranean formation having a wellbore, the wellbore having a vertical borehole with casing, and at least one deviated borehole extending from the vertical borehole, the method comprising the steps of:

(a) pumping treating solution into the wellbore, creating fluid pressure in the wellbore;

(b) dispersing the treating solution at a downhole location;

(c) pulling a working string having a plurality of pipe joints from the wellbore while pumping treating solution into the wellbore; and (d) uncoupling one or more pipe joints from the working string while maintaining fluid pressure in the wellbore.

15. The method of claim 14 wherein the treating solution is pumped downwardly into an annulus between the casing and the working string.

16. The method of claim 14 wherein the treating solution is pumped from the annulus between the casing and the working string downward into the interior of the working string and then into the annulus between the working string and the deviated borehole.

17. The method of claim 14 wherein a seal member seals the working string in sliding engagement with the casing.

18. The method of claim 14 wherein a check valve member positioned above a perforated nipple prevents upward flow in the working string.

19. The method of claim 14 wherein a seal element positioned between the working string and the casing allows relative movement of the working string within the casing.

20. The method of claim 14 wherein the working string is maneuvered within the deviated borehole while pumping the treating solution into the deviated borehole.

* * * * *